US008074539B2

(12) United States Patent
Lin

(10) Patent No.: US 8,074,539 B2
(45) Date of Patent: Dec. 13, 2011

(54) SOCKET DEVICE WITH INDICATION PORTION

(76) Inventor: Yu-Chun Lin, Taichung (TW)

( * ) Notice: Subject to any disclaimer, the term of this patent is extended or adjusted under 35 U.S.C. 154(b) by 1026 days.

(21) Appl. No.: 11/962,080

(22) Filed: Dec. 20, 2007

(65) Prior Publication Data

US 2008/0113565 A1 May 15, 2008

Related U.S. Application Data

(63) Continuation-in-part of application No. 11/232,143, filed on Sep. 22, 2005, now abandoned.

(51) Int. Cl.
*B25B 13/06* (2006.01)

(52) U.S. Cl. ..... 81/121.1; 81/DIG. 5

(58) Field of Classification Search ..... 81/121.1, 81/177.1, 119, 180.1, 185.2, 184, DIG. 5; 40/310, 316, 317, 913, 306, 334
See application file for complete search history.

(56) References Cited

U.S. PATENT DOCUMENTS

| | | | | |
|---|---|---|---|---|
| 4,206,818 | A * | 6/1980 | Beckham et al. | 172/781 |
| 4,759,139 | A * | 7/1988 | Ricks | 40/638 |
| 6,282,994 | B1 * | 9/2001 | Wei | 81/121.1 |
| 6,393,950 | B1 * | 5/2002 | Crosser | 81/119 |
| 6,761,093 | B2 * | 7/2004 | Chang | 81/121.1 |
| 6,820,521 | B2 * | 11/2004 | Dobson et al. | 81/119 |

* cited by examiner

*Primary Examiner* — Debra S Meislin
(74) *Attorney, Agent, or Firm* — Egbert Law Offices PLLC

(57) ABSTRACT

A socket device with an indication portion comprises a colored sleeve; the sleeve being made by high molecular organic plastics; a socket; the sleeve being rotatable installed on the socket; an indication portion on a surface of the sleeve for indicating a value about the size of the socket. The socket has an annular recess for receiving the sleeve. The sleeve may be an annular ring; or the sleeve is a C ring; or the sleeve has a protrusion and the protrusion is received in the annular recess.

4 Claims, 3 Drawing Sheets

SOCKET DEVICE WITH INDICATION PORTION

The invention is a continuation in part (CIP) of U.S. patent application Ser. No. 11/232,143 file Sep. 22, 2005, now abandoned which is assigned and invented by the inventor of the present invention. Thus the contents of the U.S. patent application Ser. No. 11/232,143 is incorporated into the present invention as a part of the present invention.

FIELD OF THE INVENTION

The present invention relates to sockets, and in particular to a socket device with an indication portion which indicates the size of the socket and the indication can be retained for a long time.

BACKGROUND OF THE INVENTION

Currently, there are many kinds of sockets with various sizes. Thereby it is necessary to indicate the size of a socket. In one prior art, the socket has two annular recesses at two sides. Each recess has a protrusion. Color strips are adhered on the recess for indicating the size of the socket. The stripes are coated with oil or films as a protection layer. The stripes serve to indicate the size of the socket by two different specifications. In one prior art, the socket is formed with slide-stop trenches. A concave indication portion is formed on the periphery of the socket. Color layers are formed on the concave portion.

However all in the prior art have color layers coated on the peripheries of sockets. Protection layers or electric plating processes are used to protect the color layers. The sockets are frequently used tools. They are easy to wear or corrode in use or storage. Thereby above mentioned ways are not preferred. There is an eager demand for a novel one which can improve the prior art defects.

SUMMARY OF THE INVENTION

Accordingly, the primary object of the present invention is to provide a socket device with an indication portion which indicates the size of the socket and the indication can be retained for a long time.

To achieve above objects, the present invention provides a socket device with an indication portion comprises a colored sleeve; the sleeve being made by high molecular organic plastics; a socket; the sleeve being rotatable installed on the socket; an indication portion on a surface of the sleeve for indicating a value about the size of the socket. The socket has an annular recess for receiving the sleeve. The sleeve may be an annular ring; or the sleeve is a C ring; or the sleeve has a protrusion and the protrusion is received in the annular recess.

The various objects and advantages of the present invention will be more readily understood from the following detailed description when read in conjunction with the appended drawing.

BRIEF DESCRIPTION OF THE DRAWINGS

FIGS. 2-1, 2-2 and 2-3 are schematic views about the socket device with an indication portion in the second embodiment of the present invention.

FIGS. 3-1 and 3-2 are schematic views about the socket device with an indication portion in the third embodiment of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
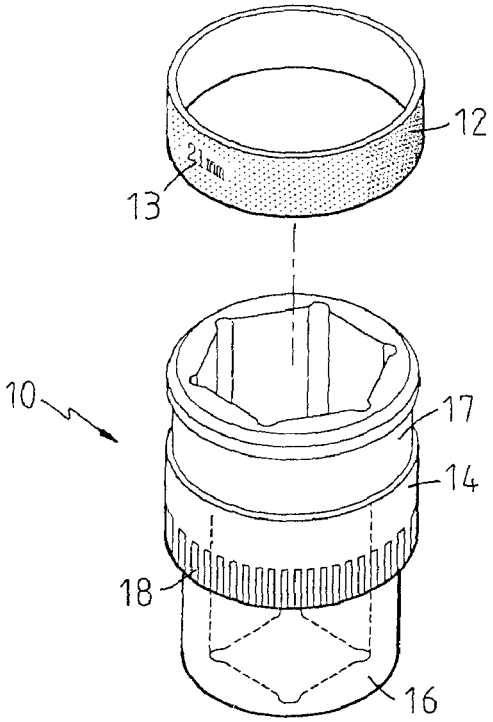
FIGS. 1-1, 1-2 and 1-3 are schematic views about the socket device with an indication portion in the first embodiment of the present invention.
Figures 1, 2:
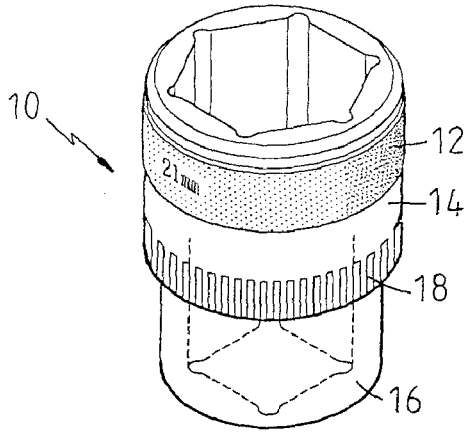
Figures 1, 2, 3:
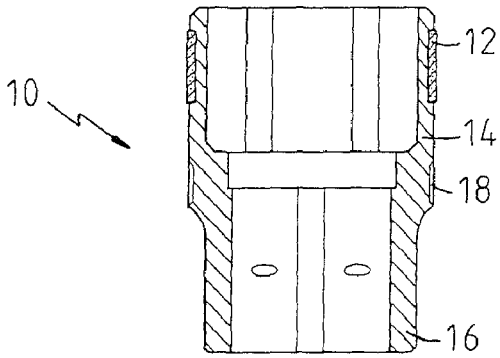
Figures 1, 2:
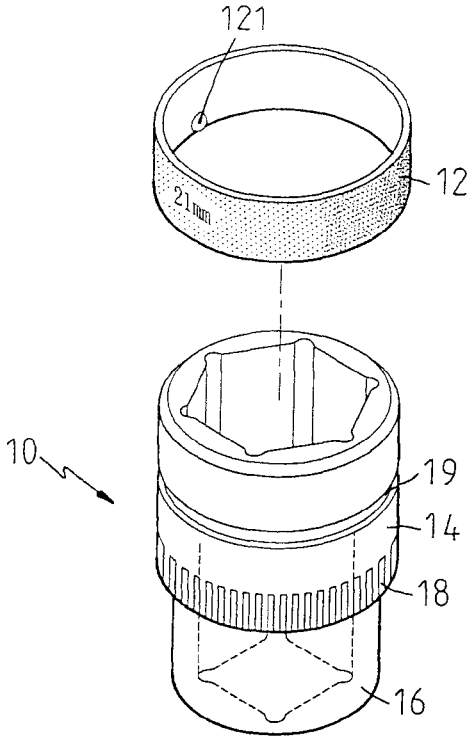
Figure 2:
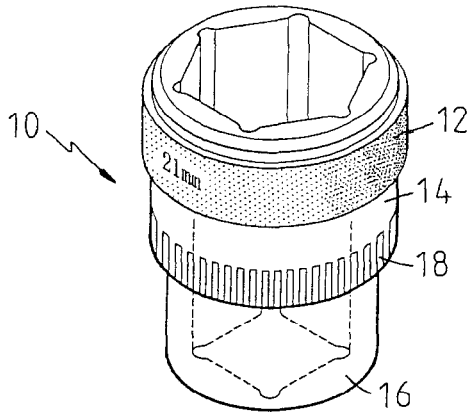
Figures 2, 3:
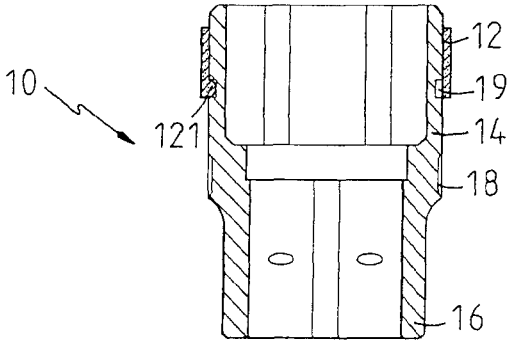
Figures 1, 3:
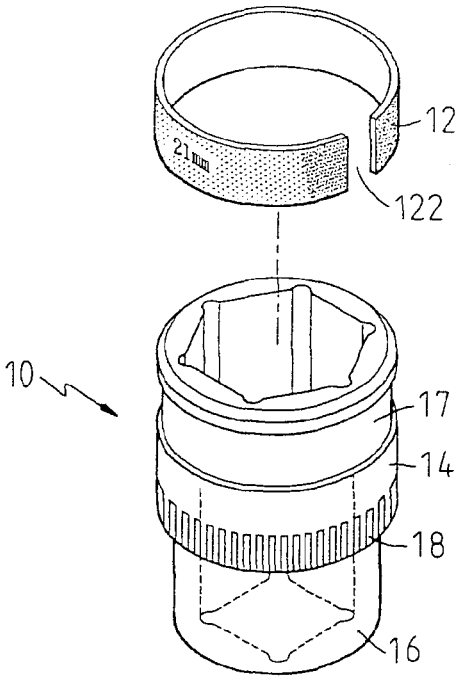
Figures 2, 3:
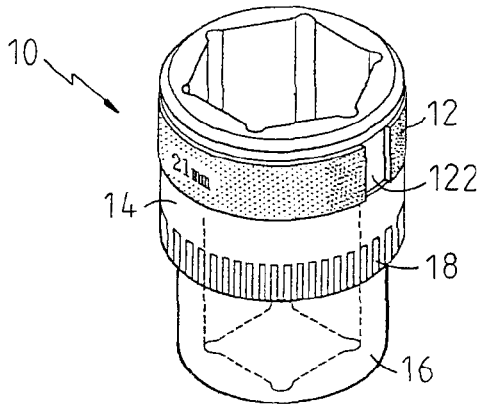

With reference to FIGS. 1-1, 1-2 and 1-3, the structure about the first embodiment of the present invention is illustrated. The present invention has the following elements.

A sleeve 12 is an annular ring.

A socket 10 is included. An upper edge of the socket 10 is formed with an flange; and the sleeve being installed below the flange. One side of an inner side of the socket has a hexagonal hole; and each apex of the hexagonal hole having a approximate half round shape. Another side of an inner side of the socket has a rectangular hole; each apex of the rectangular hole having an approximate half round shape;

The socket 10 has a large diameter portion 14 and a small diameter portion 16. A periphery of the large diameter portion 14 has a plurality of slide-stop trenches 18. The socket 10 has an annular recess 17 for receiving the sleeve 12. The sleeve 12 is rotatable along the socket 10. The sleeve 12 may be made by plastics and thus is elastic. The sleeve 12 is colored.

A surface of the sleeve 12 has an indication portion 13 which indicates a value about the size of the socket 10. The sleeve 12 is made by injection molding of high molecular organic material. Thereby the color of the sleeve 12 is firmly secured thereon and the sleeve 12 is a wear-endurable design. Thereby the indication on the sleeve 12 can be retained for a long time. This is better than the prior arts which are formed by using rolling printing, electric plating and black dying.

Furthermore, in the present invention, the sleeve 12 is rotatable along the annular recess 17. Thus the indication portion 13 can be rotated to a position which can be easily viewed by viewers, specifically when the socket 10 is placed in the toolbox.

Referring to FIGS. 2-1, 2-2 and 2-3, the structure about the second embodiment of the present invention is illustrated. In this embodiment, those identical to the above embodiment will not be further described herein. Only those different from above embodiment are described. The present invention has the following elements.

A sleeve 12 is an annular ring. An inner side of the sleeve 12 has a protrusion 121.

A socket 10 has a large diameter portion 14 and a small diameter portion 16. A periphery of the large diameter portion 14 has a plurality of slide-stop trenches 18. The socket has an annular recess 19 above the slide-stop trenches for receiving the annular ring of the sleeve; so that the sleeve being protruded from an outer surface of the large diameter portion of the socket. Thereby the sleeve 12 is retained to the annular recess 19 and is rotatable along the socket 10 by the protrusion 121 to slide in the annular recess 19. The sleeve 12 may be made by plastics and thus is elastic. The sleeve 12 is colored.

A surface of the sleeve 12 has an indication portion 13 which indicates a value about the size of the socket 10. The sleeve 12 is made by injection molding of high molecular organic material. Thereby the color of the sleeve 12 is firmly secured thereon and the sleeve 12 is a wear-endurable design. The indication on the sleeve 12 can be retained for a long time. This is better than the prior arts by using rolling printing, electric plating and black dying.

Referring to FIGS. 3-1 and 3-2, the structure about the third embodiment of the present invention is illustrated. The present invention has the following elements.

A sleeve 12 is a C ring with an opening 122.

A socket 10 has a large diameter portion 14 and a small diameter portion 16. A periphery of the large diameter portion 14 has a plurality of slide-stop trenches 18. The socket 10 has an annular recess 17 for receiving the sleeve 12. The sleeve 12 is rotatable along the socket 10. The sleeve 12 may be made by plastics and thus is elastic. The sleeve 12 is colored.

A surface of the sleeve 12 has an indication portion 13 which indicates a value about the size of the socket 10. The sleeve 12 is made by injection molding of high molecular organic material. Thereby the color of the sleeve 12 is firmly secured thereon and the sleeve 12 is a wear-endurable design. Thereby the indication on the sleeve 12 can be retained for a long time. This is better than the prior arts by using rolling printing, electric plating and black dying.

In the present invention, the indication value on the indication portion 13 can be made by laser printing.

Furthermore, in the present invention, the sleeve 12 is rotatable along the annular recess 17. Thus the indication portion 13 can be rotated to a position which can be easily viewed by viewers, specifically when the socket 10 is placed in the toolbox.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A socket assembly comprising:

a socket having a flange formed at an upper edge thereof, said socket having a first portion in spaced relation to said flange and a second portion extending from said first portion at an end thereof opposite said flange, said first portion having a diameter greater than a diameter of said second portion, said first portion having a periphery adjacent said second portion, said periphery having a plurality of slide-stop trenches formed therein, said socket having an annular recess formed between said flange and said first portion; and a colored sleeve formed of an elastic high molecular organic polymer, said colored sleeve being rotatably positioned on said annular recess, said colored sleeve having an outer diameter slightly greater than said diameter of said first portion, said sleeve having indicia thereon indication of a size of said socket.

2. The socket assembly of claim 1, said socket having a hexagonal hole extending into one end thereof, said hexagonal hole having a plurality of apexes, each of said plurality of apexes having a semi-circular shape, said socket having a rectangular hole extending into an opposite end thereof, said rectangular hole having a plurality of apexes, each of said plurality of apexes of said rectangular hole having a semi-circular shape.

3. The socket assembly of claim 1, said sleeve being an O-ring.

4. The socket assembly of claim 2, said sleeve being an O-ring.

* * * * *